US005359798A

United States Patent [19]

Pelosi

[11] Patent Number: 5,359,798

[45] Date of Patent: Nov. 1, 1994

[54] IDENTIFICATION PENDANT

[76] Inventor: Raymond K. Pelosi, 5446 Arthur Kill Rd., Staten Island, N.Y. 10307

[21] Appl. No.: 895,651

[22] Filed: Jun. 9, 1992

[51] Int. Cl.[5] ..... G09F 03/18; A44C 15/00

[52] U.S. Cl. ..... 40/642; 63/19

[58] Field of Search ..... 40/642, 655; 63/18, 63/19

[56] References Cited

U.S. PATENT DOCUMENTS

| | | | |
|---|---|---|---|
| 270,296 | 1/1883 | Foster | 63/19 |
| 273,057 | 2/1883 | Foster | 63/19 |
| 296,741 | 4/1884 | Gould | 63/19 |
| 1,537,899 | 5/1925 | Stubbs | 40/642 |
| 2,185,641 | 1/1940 | Mark | 63/19 |
| 3,178,842 | 4/1965 | Zimmerman | 40/642 |
| 4,197,665 | 4/1980 | Siiter | 40/642 X |

*Primary Examiner*—Kenneth J. Dorner
*Assistant Examiner*—J. Bonifanti
*Attorney, Agent, or Firm*—Dennis H. Lambert

[57] ABSTRACT

A miniaturized device adapted to be worn as a piece of jewelry and which contains personal identification and/or medical information about the person wearing the device. The device includes a housing in which first and second panels are hingedly mounted for movement between closed positions stored in the housing and upright exposed positions generally parallel to one another outside the housing at opposite ends thereof. One of the panels carries a piece of microfilm containing the information, and the other panel carries a lens adapted to focus on the microfilm when the panels are in their upright positions outside the housing. The housing includes an openable cover so that the panels are enclosed and protected when the cover is closed. The panels are urged toward their upright positions by spring means when the cover of the housing is opened, and detents formed in the housing engage with the panels to positively hold them in their upright, properly spaced relationship when they are opened for use.

17 Claims, 9 Drawing Sheets

IDENTIFICATION PENDANT

BACKGROUND OF THE INVENTION

1. Field of the Invention

This invention relates to devices for displaying personal information, and especially to a device that contains medical information and/or other personal identification that may be needed in an emergency situation.

People are sometimes subjected to conditions that require them to undergo emergency medical treatment. Such treatment may typically involve the administration of blood and/or drugs, or may require other procedures that could cause further harm to the person if certain precautions are not taken. For instance, it essential to know the blood type of persons receiving blood transfusions, and to know if that person is allergic or otherwise experiences adverse reactions to certain drugs. Further, medical devices or prostheses, such as a heart pacemaker, or contact lenses or the like may be worn by the person being treated. In addition, there may be aspects of that person's medical history which are essential to proper treatment, whereby consultation with that person's personal physician would be desirable in order to obtain the medical history or other data useful in the treatment of the person.

In many instances, the person who must receive emergency medical treatment is either unconscious or otherwise unable to be of assistance to rescue and/or medical personnel. Thus, the information noted above, and essential to the treatment of the person, may not be readily and quickly obtainable from the person or from normal channels of such information.

To solve this problem, various devices are typically employed in the prior art, including cards that are adapted to be carried in a person's wallet or pocketbook, or I.D. tags and the like that may be worn about the neck of the person. Miniaturized viewers have also been devised, carrying medical and other personal information on a small piece of microfilm that may be read through a lens provided on the device.

Thus, in a medical emergency the treating physician has immediate access to critical medical information that could save the life of a person wearing such a device.

2. Description of the Prior Art

A variety of miniaturized viewing devices for containing medical information are disclosed in U.S. Pat. Nos. 3,178,842, 4,249,330, 4,435,912, 4,468,874 and 4,574,505.

Pat. Nos. 3,178,842, 4,468,874 and 4,574,505 all describe collapsible viewers having one part that carries a piece of microfilm and another part that carries a lens for viewing the microfilm. These devices are relatively complex in construction and assembly, adding to their cost. Moreover, when they are in their collapsed, inoperative condition they tend to be unsightly, and may discourage some persons from wearing them in a readily visible position, such as on a necklace or bracelet. If the device is worn or carried in a location that is normally out of sight, such as in a pocket or the like, its utility is significantly diminished, since medical personnel may be reluctant or even prohibited from searching a person in an effort to locate such a device.

Pat. No. 4,435,912 describes a card that is adapted to be carried in a wallet or pocketbook or the like, and which includes a piece of microfilm on one part and a lens on another part that may be bent into operative relationship with one another so that the film can be viewed. This device is susceptible to damage from the environment, and is normally carried in a pocket or other location that may prevent its being discovered by personnel attending to the treatment of the person.

Pat. No. 4,249,330 discloses a device that has a fixed, closed housing with a lens in one end and a piece of microfilm in the other end. Although the lens and film are protected from many potentially damaging elements in the environment, the construction of the device still renders the lens and film susceptible to the collection of dirt or other foreign matter which might make the film difficult or impossible to read. Moreover, the fixed relationship of the film-carrying part to the lens-carrying part dictates a particular size to the device, and even though the device is described as capable of being worn as a piece of jewelry, it would appear to be relatively large and may discourage some from wearing it as jewelry.

Further, conventional devices do not provide any readily discernible means, such as contrasting colors and the like, for enabling medical personnel to quickly and easily identify essential information.

There is thus need for a device that carries easily located and quickly identified medical and/or other personal information, and which is small and attractive so as to encourage its use in a readily visible location, and further, which has means to normally protect the operative components thereof from dirt or other foreign matter.

Summary of the Invention

In accordance with the present invention, a device for carrying medical and/or other personal information includes collapsible components so that it is small and compact in design, and has a housing to protect the sensitive components from environmental damage.

More specifically, the device has one foldable panel that carries a piece of microfilm with medical information or the like thereon, and another, opposed foldable panel that carries a lens for viewing the microfilm. The two panels are collapsible or foldable into overlying relationship with one another in a housing, and a housing cover is adapted to close over the panels to protect them from dirt and the like.

In a preferred construction, contrasting colors are used for the questions and answers on the microfilm, so that medical personnel can quickly and easily identify appropriate medical information on the film. For instance, the questions can be in black, and the answers in red.

Resilient, spring-like means between the foldable panels and a base member are operative to urge the panels upwardly toward an upright, exposed position when the cover is opened, and positive detent means engage between the panels and housing to secure the panels in properly spaced, unfolded, operative positions for use.

When in its collapsed, inoperative condition, the housing is small and compact in design and may be coated with gold or sliver or the like to make it suitable to be worn as a piece of jewelry. It is therefore readily visible and may be easily discovered by rescue or medical personnel for use in an emergency.

The housing is preferably made of metal, such as brass, and may be easily and inexpensively manufactured. Further, it may be suitably coated with a precious or semi-precious metal to form the housing into a piece of jewelry. The foldable panels and base member are prefer-ably made from a single piece of plastic material, with the panels joined to the base member along living hinges, which define the spring-like means. Alternatively, the spring-like means may comprise one or more pieces of strategically placed foam material. The base member may be secured in the housing by suitable adhesive means, such as double-sided tape, and the detents for holding the panels in positively located operative positions may comprise indentations in the metal walls forming the housing.

The microfilm may be carried in opposed slots or undercut shoulders formed in one of the foldable panels, for easy replacement of the film as information is updated, for example.

Construction is thus simple and economical, and the resulting device is both attractive and easy to use. Moreover, as contrasted with those prior art devices known to applicant, the housing and cover in the present invention protect the film and lens from damage or contamination by foreign matter.

BRIEF DESCRIPTION OF THE DRAWINGS

The foregoing, as well as other objects and advantages of the invention will become apparent from the following detailed description when it is considered in conjunction with the accompanying drawings, wherein like reference characters designate like parts throughout the several views, and wherein.

DETAILED DESCRIPTION OF THE PREFERRED EMBODIMENTS

Figure 1:
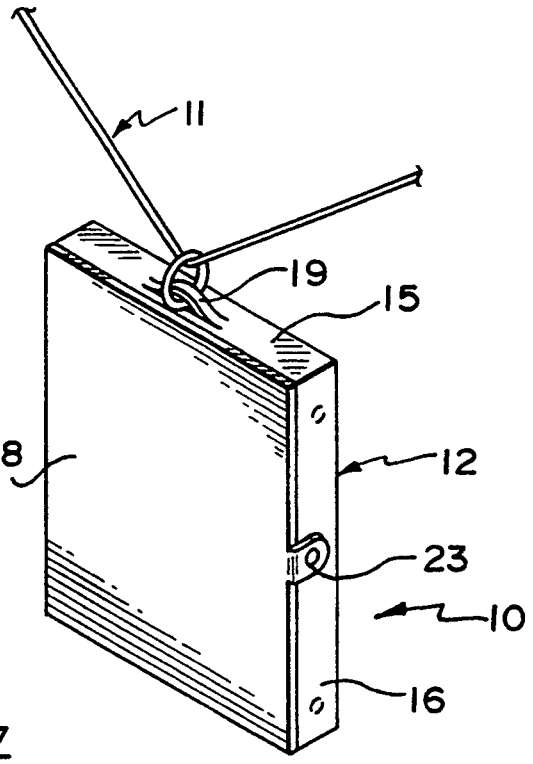
FIG. 1 is a top perspective view of a preferred form of device in accordance with the invention being worn as a pendant on a necklace.
Figure 2:
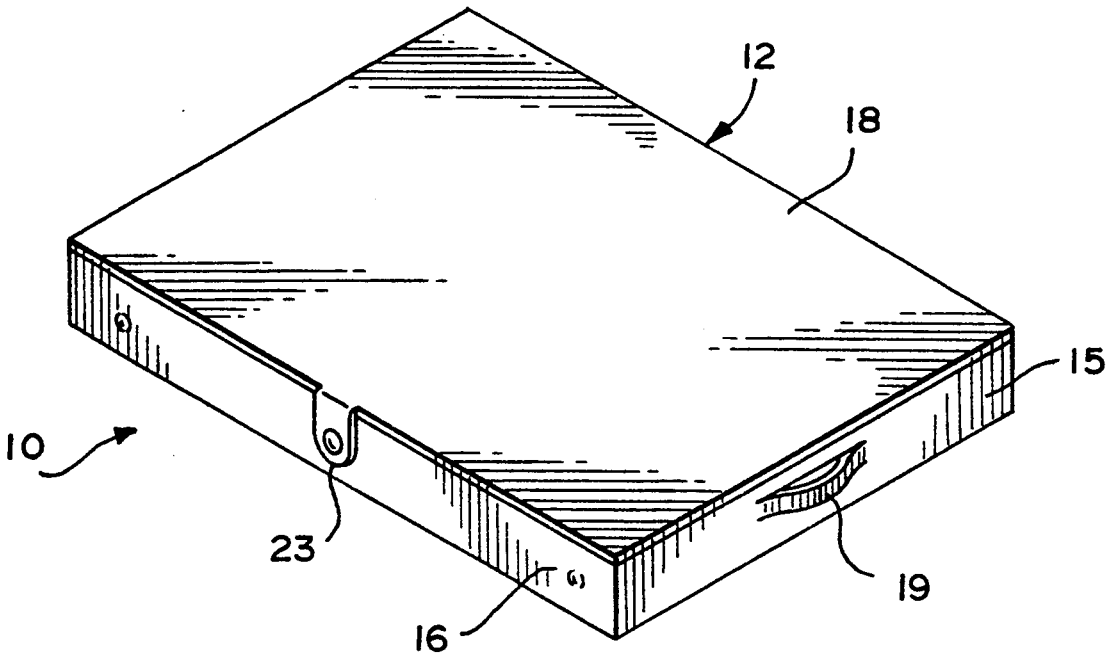
FIG. 2 is an enlarged, top perspective view of the device of FIG. 1, shown lying on its back in a position ready for use.

A preferred form of device in accordance with the invention is shown at 10 in FIGS. 1–7 in the drawings, and comprises a pendant for suspension from a necklace 11. The device could also be supported from a bracelet, pin or other means, as desired.

In this form of the invention, the device includes a housing 12 formed of metal or other suitable material. A preferred construction uses brass, for example, because of its strength and ability to be coated with gold or sliver and the like. The housing has a bottom wall 13, opposite end walls 14 and 15, opposed front and back walls 16 and 17, and a cover 18. One end wall 15 has a portion 19 cut and deflected outwardly to serve as an attachment for a necklace or the like.

A pair of tabs 20 on the cover are inserted through slots 21 in the back wall 17 and rolled over to form hinges 22 pivotally connecting the cover to the back wall. The cover is held closed or latched to the housing by a tab 23 that extends downwardly alongside the front wall 16 and into operative relationship with a recess 24 formed in the front wall.

A plastic base member 30 having foldable panels 31 and 32 joined to opposite ends thereof along living hinges 33 and 34 is secured in the housing by suitable means, such as double-sided tape 35 engaged between the base member 30 and the bottom wall of the housing. One of the panels 31 carries a piece of microfilm 36 having desired medical information and/or personal identification encoded thereon, represented schematically at 1 in FIGS. 4, 5, 7, 8 and 10. The other panel has a lens 37 with a focal length adapted to focus on the microfilm when the panels are in their upright position as shown in FIG. 4, for example.

The microfilm is preferably releasably held to the panel 31 by a pair of opposed, spaced shoulders 51 and 52 which receive and hold the opposite side edges of the piece of microfilm. This enables the film to be removed and replaced when necessary or desired to update information contained thereon.

Figure 3:
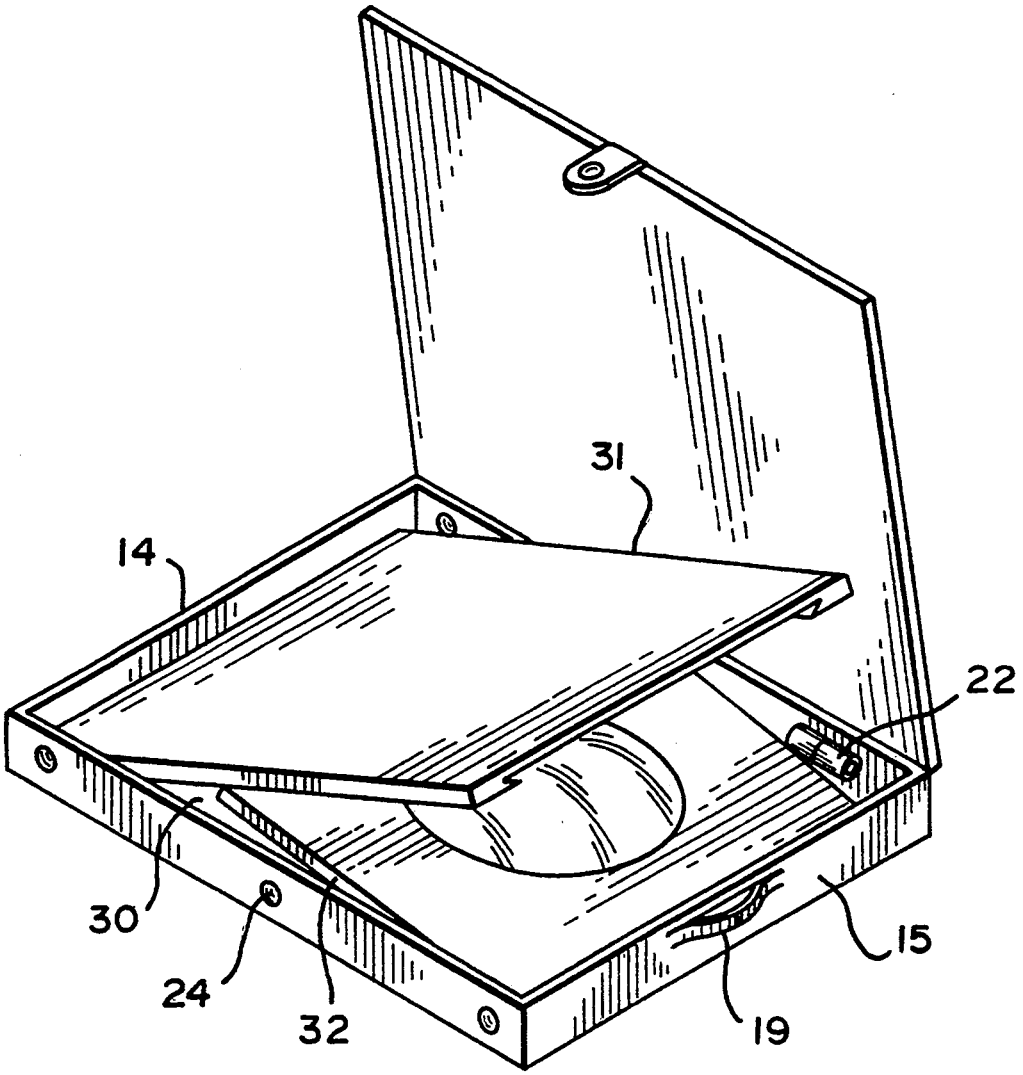
FIG. 3 is a further enlarged top perspective view of the device of FIG. 2, showing the cover of the housing in an open position, and with the folded panels springing upwardly preparatory to use.
Figure 4:
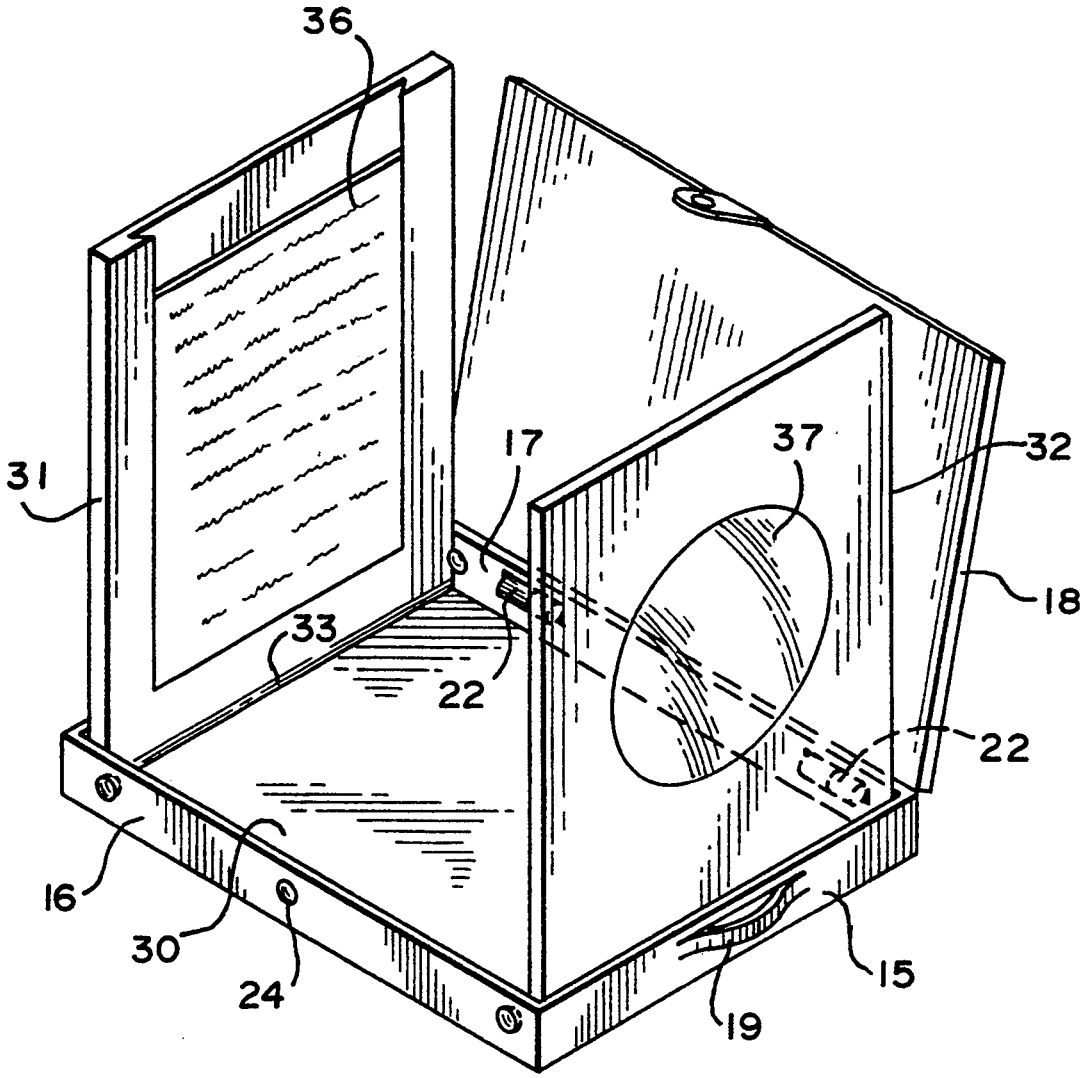
FIG. 4 is an enlarged top perspective view of the device of FIG. 3, showing the device of the invention in an unfolded operative position for use.
Figure 5:
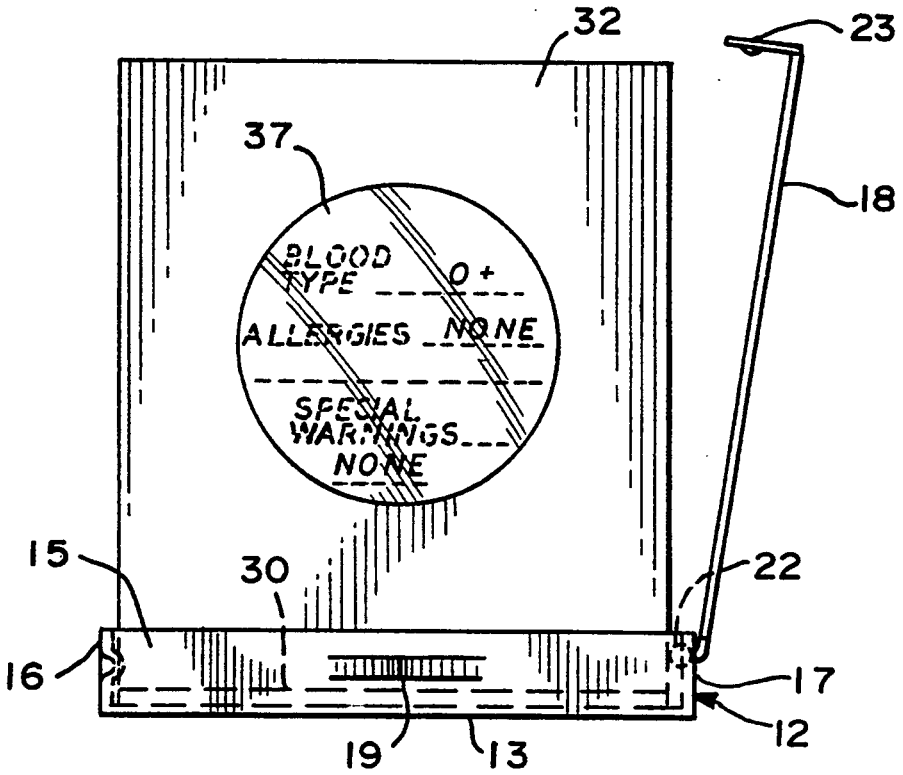
FIG. 5 is an end view of the device of FIG. 4, looking through the lens at the piece of microfilm.
Figure 6:
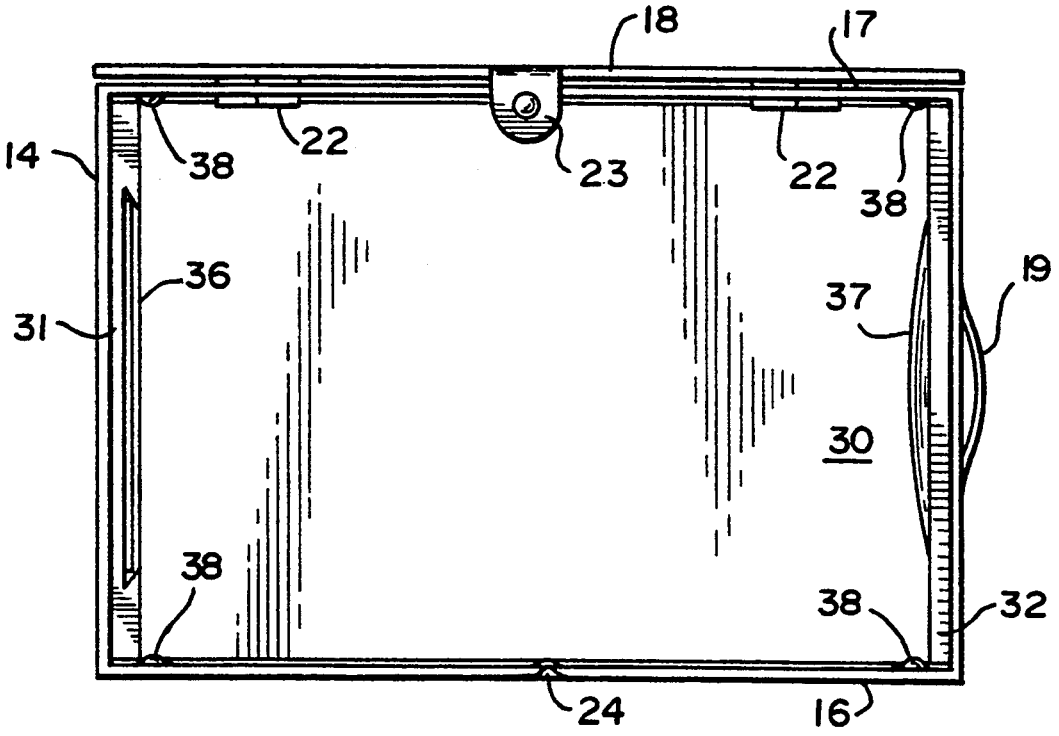
FIG. 6 is a top plan view of the device of FIG. 5.
Figure 7:
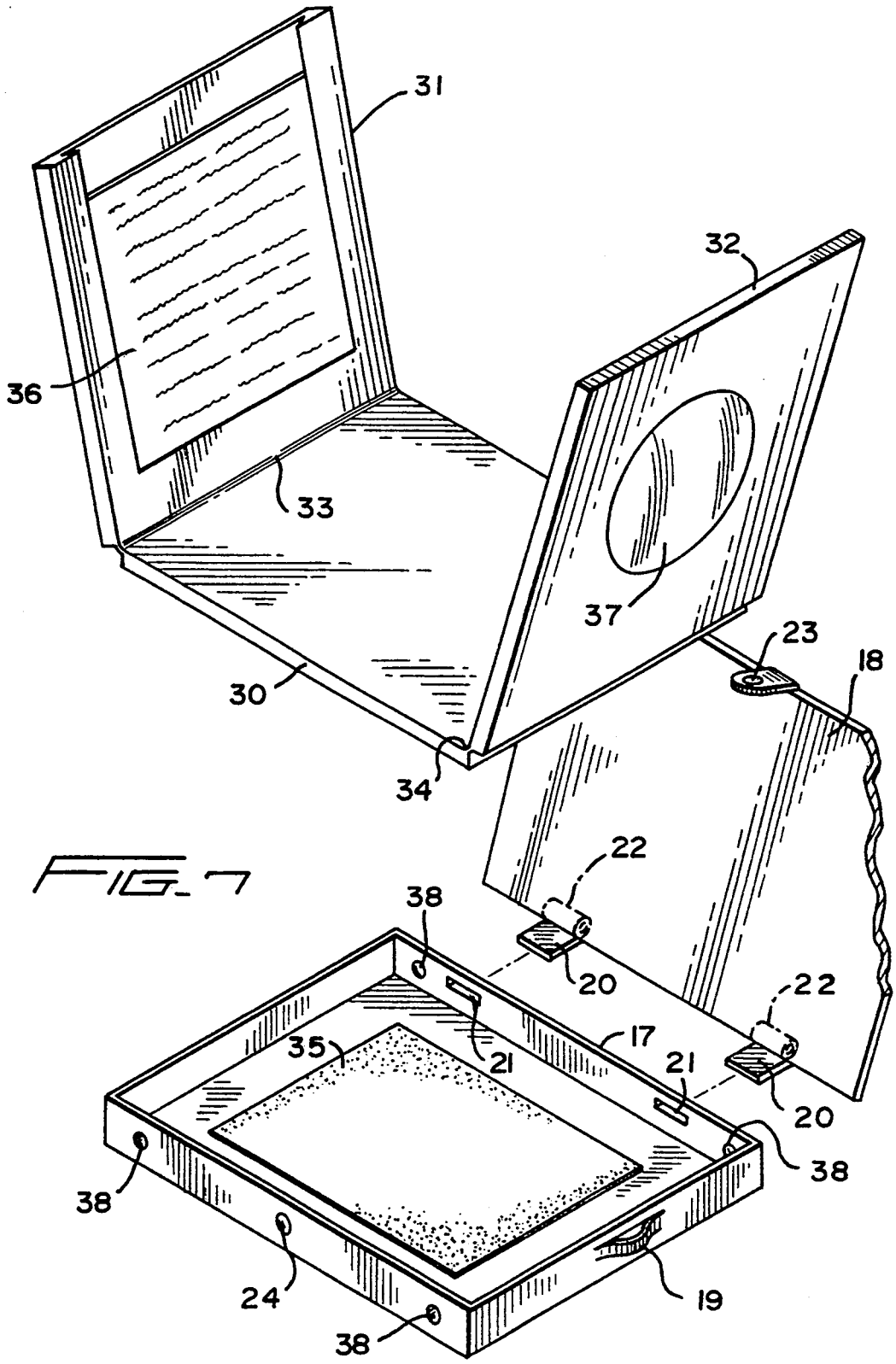
FIG. 7 is an exploded top perspective view of the device of FIG. 4, showing the various components of the device of the invention.

The living hinges 33 and 34 comprise spring-like means which bias the panels 31 and 32 upwardly to the position shown in FIG. 3, where the panels may be grasped and moved upwardly to their operative positions shown in FIG. 4.

Suitable indentations 38 are formed in the front and back walls in locations to enable the panels to pivot past the indentations when the panels are moved into their upright positions, and define stops or detents to hold the panels in these positions, where they are essentially parallel to one another and are spaced apart a distance equal to the focal length of the lens.

Figure 8:
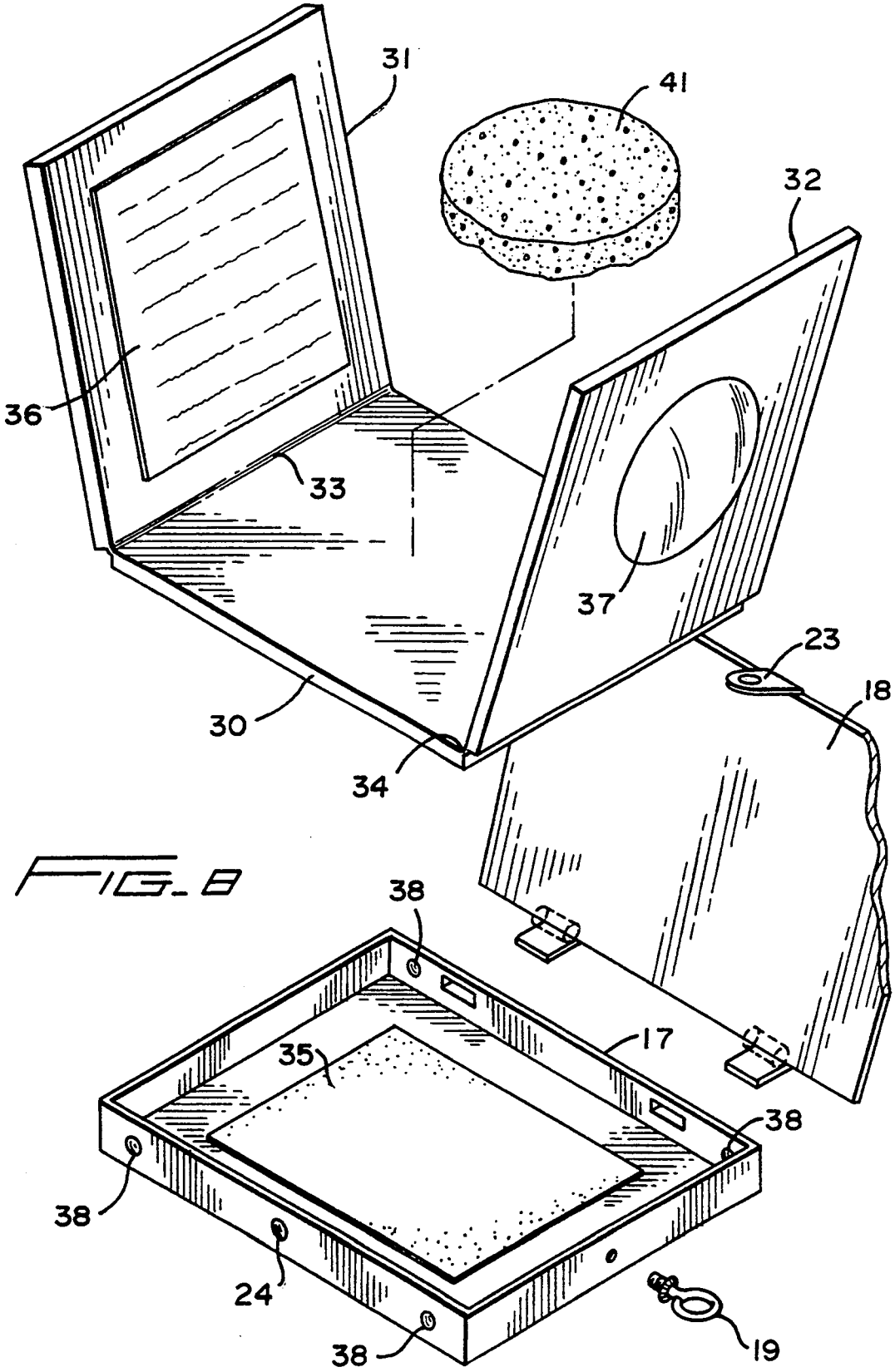
FIG. 8 is an exploded, perspective view similar to FIG. 7, showing a first modification of the invention in which a block of resilient foam material functions as a spring to urge the panels toward their upright, exposed positions.
Figure 9:
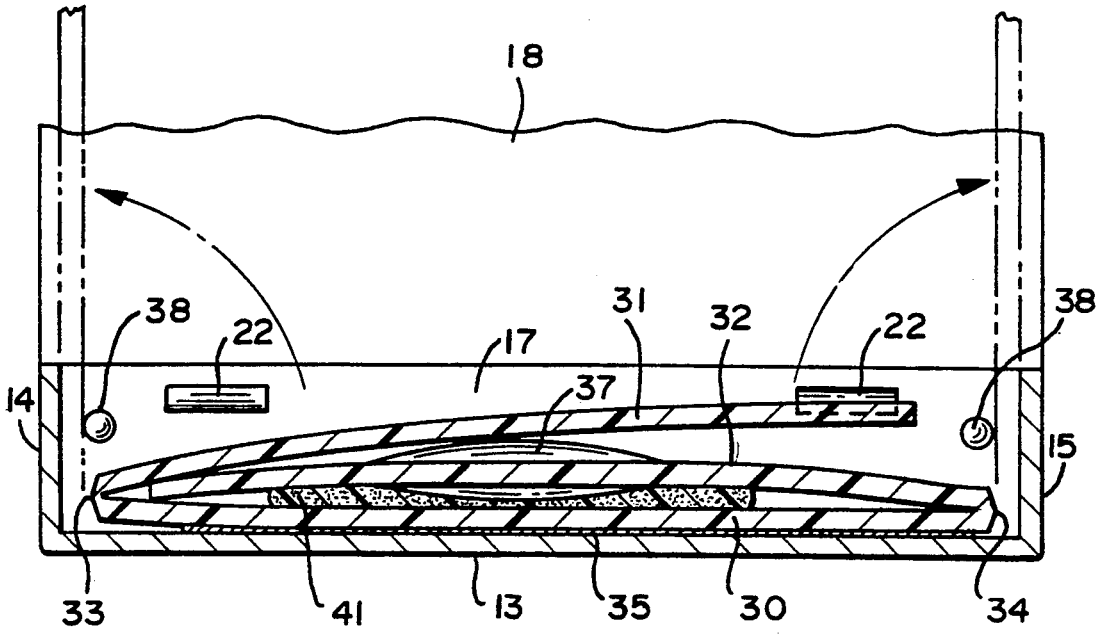
FIG. 9 is an enlarged fragmentary view of the device of FIG. 8, in longitudinal section, showing how the foam rubber spring means urges the folded panels upwardly, and showing the relationship of the detents with the upright panels.

A first modification is indicated generally at 45 in FIGS. 8 and 9. In this form of the invention, a block or disc of foam rubber material 46 is secured on the upper surface of the base member such that when the panels 31 and 32 are folded to their collapsed position overlying the base member, the foam material is compressed and forms a spring. Consequently, when the cover is opened, as shown in FIG. 3, the foam material expands and urges the panels upwardly toward their upright positions so that they may be grasped and pivoted upwardly into their full unfolded positions against the end walls as shown in FIG. 4. The foam material also protects the lens by padding it from direct contact with the bottom wall of the housing.

Further, rather than the cut and deflected portion 19 of the end wall to form an attachment for a necklace or the like, as in the first form of the invention, a suitable, conventional post or ring 47 is affixed to wall 15 of the housing to suspend it from a necklace or bracelet or the like.

Figure 10:
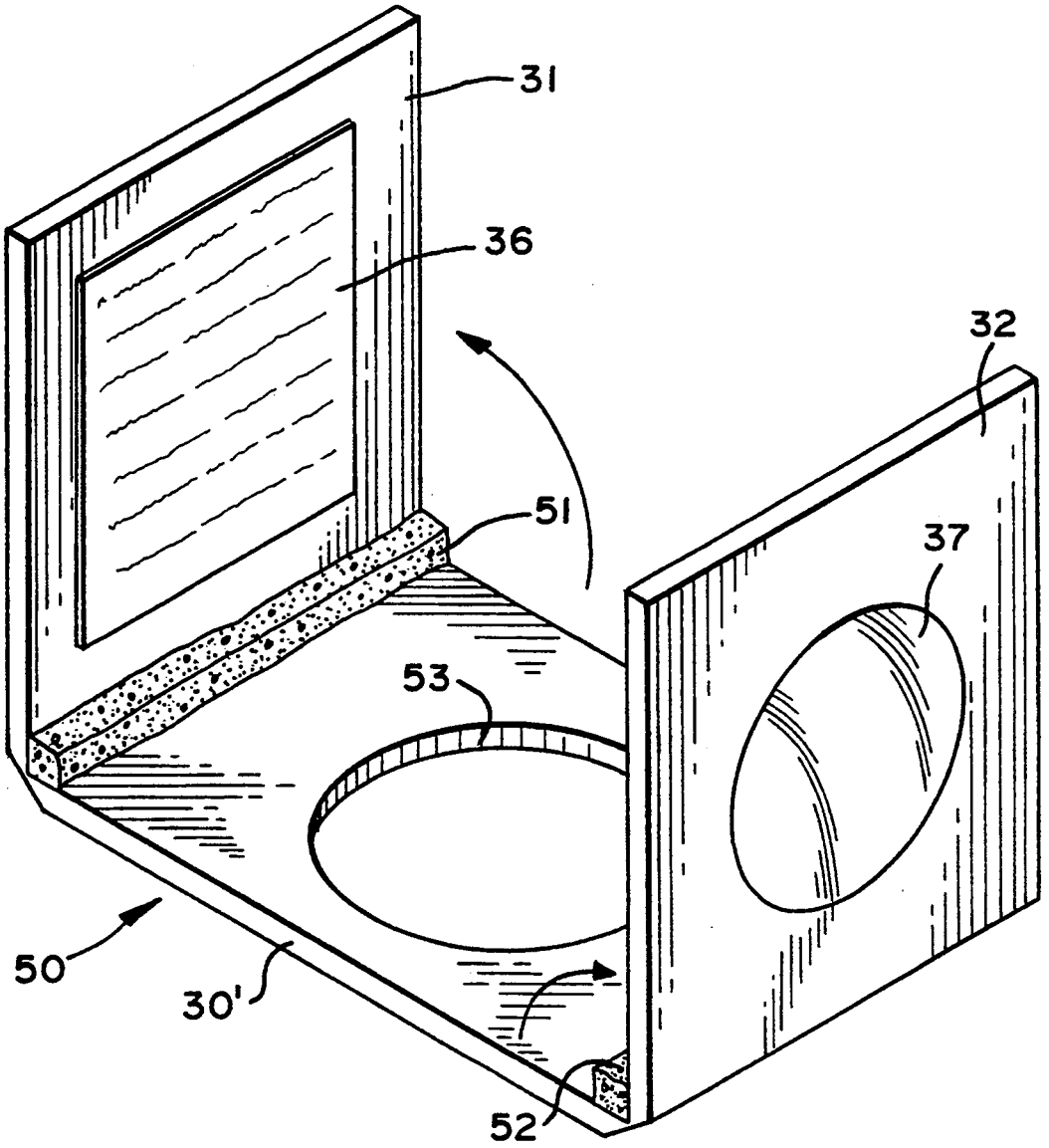
FIG. 10 is an enlarged, top perspective view of a second modification of the invention, in which a plurality of resilient blocks of foam material function as spring means.
Figure 11:
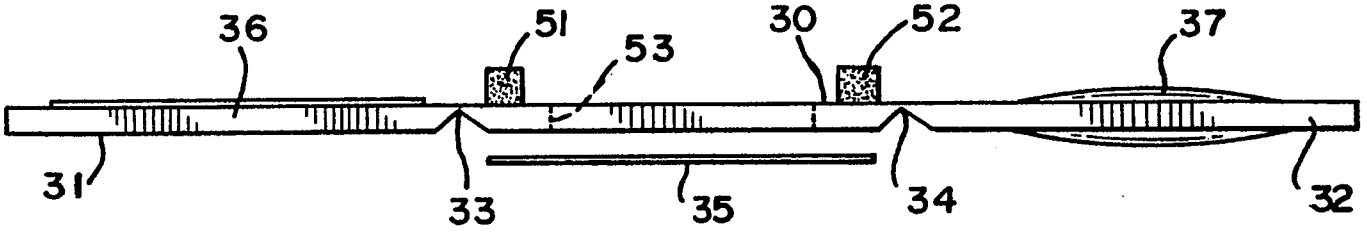
FIG. 11 is a view in side elevation of the base member of FIG. 10.
Figure 13:
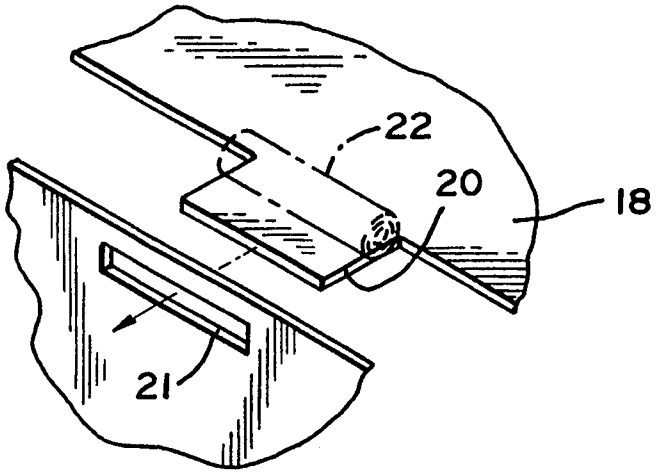
FIG. 13 is a fragmentary, perspective, exploded view of a portion of the housing of the device of the invention, showing the tab which is formed into a hinge for the cover.
Figure 12:
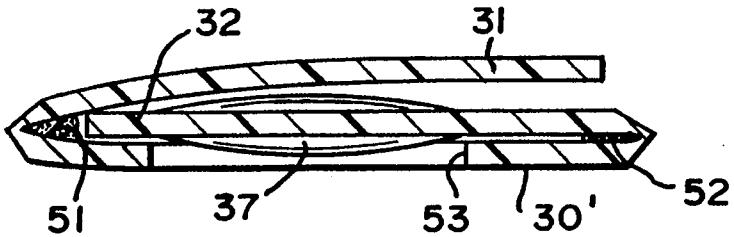
FIG. 12 is a side view of the base member and panels of FIG. 11, shown in folded, collapsed position.

A second modification of the invention is indicated generally at 50 in FIGS. 10–12. This form of the invention is essentially the same as that previously described, except that the single foam block is replaced with a relatively thin strip of foam material 51 and 52 secured in the angle formed by the base of each panel, respectively, and the base member 30'. In addition, an opening 53 is formed in the base member in a position to receive the lens 37 when the panel 32 is folded into its collapsed position overlying the base member, as shown in FIG. 11.

Further, both of the modifications described above show an alternate way of attaching the microfilm to the foldable panel. In these forms of the invention, the piece of microfilm is simply adhesively secured to the panel.

The base member and panels of the invention may be injection molded or otherwise suitably formed from a transparent or translucent plastic material, such as used in viewing X-ray films, for example, and for ease of manufacture may be molded in the position shown in FIG. 10.

In a specific construction of the invention, the housing has a length of about one inch, a width of about three-fourths of an inch, and a combined or overall thickness of about one-eighth of an inch when in its collapsed, folded state. When the panels are unfolded to their upright, operative positions, they have a height from the bottom of the housing to their free upper ends of about three-fourths of an inch. The lens has a diameter of about one-half inch and a focal length of about one inch.

The film on which the medical or personal information is contained is 16 mm color microfilm, and the questions may be in black, with the answers in red, for enhanced visibility and quicker location and identification of essential information. The base member and panels are made from a transparent or translucent plastic material having a thickness of about 0.030 of an inch.

The housing may be made of brass or aluminum or any other suitable material, and then anodized or otherwise suitably coated with a coating or layer of gold or silver or other material to enhance its appearance and make it suitable to be worn as a piece of jewelry. The brass may have a thickness of only about 0.082 of an inch, if desired, and still retain adequate strength for the intended purpose.

In use, the cover is opened, whereby the spring-like hinges or foam material urges the panels upwardly to a position where they can be grasped and moved into their full opened positions past the detents in the side walls. The detents positively hold the panels in position for proper focus of the lens with respect to the microfilm, i.e., about one inch apart. The device is then aimed at a light source and the information on the microfilm read by viewing it through the lens.

When not in use, the housing protects the film and lens from damage due to scratching or the like, and also keeps dirt and other foreign matter from collecting on the film and/or lens.

While the invention has been shown and described in detail, this invention is not to be considered as being limited to the exact form disclosed, and changes in detail and construction may be made therein within the scope of the invention, without departing from the spirit thereof.

What is claimed is:

1. A miniaturized, personal identification device, comprising:

a housing having a bottom wall, front and back walls, opposite end walls, and an openable top cover pivotally attached along one edge to the back wall of the housing;

a first foldable panel mounted about a hinge means at one end of the housing for movement between a stored position in the housing, lying generally parallel to the bottom wall, to an upright, exposed position outside the housing and lying in a plane generally perpendicular to the bottom wall and to the cover said first panel carrying a piece of microfilm or other suitable miniaturized indicia containing personal identification and/or medical information related to an individual wearing the device;

a second foldable panel mounted about a hinge means in the other end of the housing for movement between a stored position in the housing, lying generally parallel to the housing bottom wall and in stacked relationship to the first panel, to an upright, exposed position lying in a plane generally perpendicular to the housing bottom wall and parallel to the first panel, said second panel carrying a lens having a focal length essentially equal to the distance between the two panels when they are in their upright exposed positions generally parallel to one another;

said housing and openable cover defining protective means to prevent damage and/or contamination of the film and lens when the panels are in their stored positions inside the housing and the openable cover is closed, said cover, when closed, holding said first and second panels in their closed positions in the housing; and spring means engaged with the first and second panels, automatically biasing said first and second panels upwardly out of the housing to their upright exposed positions when the cover is opened.

2. An identification device as claimed in claim 1, wherein:

the panels are positively held in their upright, exposed positions generally parallel to one another by detent means engaged between the housing and panels, whereby the panels are held in properly spaced relationship for the focal length of the lens.

3. An identification device as claimed in claim 2, wherein:

the panels are mounted in the housing so that they unfold into their upright, exposed positions against respective opposite end walls of the housing;

the openable cover is pivotally mounted to the back wall; and the detents for positively holding the panels in properly spaced opened relationship comprise protrusions formed on the front and back walls of the housing, extending into positions for frictional engagement with side edge portions of the panels as they are moved into their fully opened positions against the respective end walls.

4. An identification device as claimed in claim 1, wherein:

the housing is shaped and sized as a locket or pendant adapted to be worn as jewelry about the neck of the person wearing the device.

5. An identification device as claimed in claim 1, wherein:

the panels are mounted in the housing so that they unfold into their upright, exposed positions against respective opposite end walls of the housing; and the openable cover is pivotally mounted to the back wall.

6. An identification device as claimed in claim 1, wherein:

said foldable panels are joined to a base member by living hinge means, and said living hinge means comprise said spring means.

7. An identification device as claimed in claim 1, wherein:

the spring means comprises at least one block of resilient material positioned to be compressed when the panels are in their stored positions in the housing, and the resilient material expands to urge the panels upwardly into exposed positions when the cover is opened.

8. An identification device as claimed in claim 7, wherein:

a single block of said resilient material is placed to be compressed by said second panel when the panels are folded into their stored positions inside the housing, said single block of material being positioned to engage and protect the lens carried by said second panel.

9. An identification device as claimed in claim 7, wherein:

an elongate strip of said resilient material is positioned in association with each panel adjacent the hinge means for that panel so that the resilient material is compressed when the panels are in their stored positions in the housing.

10. An identification device as claimed in claim 9, wherein:

the panels are integrally joined along living hinges to a base member secured on the bottom wall of the housing; and a cut-out is provided in the base member to provide clearance for the lens carried by the second panel when the panels are in their stored positions inside the housing.

11. An identification device as claimed in claim 1, wherein:

the panels are integrally joined along living hinges to a base member secured on the bottom wall of the housing, said base member overlying substantially the entire bottom wall of the housing and being secured thereto.

12. An identification device as claimed in claim 11, wherein:

the housing is formed of metal and the base member and panels are formed of plastic; and the housing is shaped and sized as a locket or pendant adapted to be worn as jewelry about the neck of the person wearing the device.

13. An identification device as claimed in claim 12, wherein:

the housing is coated with a precious metal such as gold or silver or the like.

14. An identification device as claimed in claim 1, wherein:

said first foldable panel has a pair of opposed, spaced apart slots or shoulders formed therein; and opposite side edges of the piece of microfilm are slidably received and held in the slots for releasably retaining the microfilm on the foldable panel.

15. An identification device as claimed in claim 1, wherein:

the indicia on the microfilm comprises questions and answers, and said questions and answers are in contrasting colors for quick and easy location and identification.

16. A miniaturized, personal identification device, comprising:

a housing having a bottom wall, front and back walls, opposite end walls, and an openable top cover pivotally mounted to the back wall;

a first foldable panel mounted about a hinge means in the housing for movement between a stored position in the housing, lying generally parallel to the bottom wall, to an upright, exposed position outside the housing, extending generally perpendicular to the bottom wall and lying against one of said end walls, said first panel carrying a piece of microfilm or other suitable miniaturized indicia containing personal identification and/or medical information related to an individual wearing the device;

a second foldable panel mounted about a hinge means in the housing for movement between a stored position in the housing, lying generally parallel to the housing bottom wall and in stacked relationship to the first panel, to an upright, exposed position extending generally perpendicular to the housing bottom wall and parallel to the first panel, and lying against the other end wall, said second panel carrying a lens having a focal length essentially equal to the distance between the two panels when they are in their upright exposed positions generally parallel to one another;

said panels positively held in their upright, exposed positions generally parallel to one another by detent means engaged between the housing and panels, whereby the panels are held in properly spaced relationship for the focal length of the lens; and said housing and openable cover define protective means to prevent damage and/or contamination of the film and lens when the panels are in their stored positions inside the housing and the openable cover is closed.

17. A miniaturized, personal identification device, comprising:

a housing having a bottom wall, front and back walls, opposite end walls, and an openable top cover;

a first foldable panel mounted about a hinge means in the housing for movement between a stored position in the housing, lying generally parallel to the bottom wall, to an upright, exposed position outside the housing and extending generally perpendicular to the bottom wall, said first panel carrying a piece of microfilm or other suitable miniaturized indicia containing personal identification and/or medical information related to an individual wearing the device;

a second foldable panel mounted about a hinge means in the housing for movement between a stored position in the housing, lying generally parallel to the housing bottom wall and in stacked relationship to the first panel, to an upright, exposed position extending generally perpendicular to the housing bottom wall and parallel to the first panel, said second panel carrying a lens having a focal length essentially equal to the distance between the two panels when they are in their upright exposed positions generally parallel to one another;

said panels being urged toward their opened, operative positions exposed outside the housing by at least one block of resilient material positioned to be compressed when the panels are in their stored positions in the housing, and the resilient material expands to urge the panels upwardly into exposed positions when the cover is opened; and said housing and openable cover define protective means to prevent damage and/or contamination of the film and lens when the panels are in their stored positions inside the housing and the openable cover is closed.

* * * * *